US010593528B2

(12) United States Patent
Denny et al.

(10) Patent No.: US 10,593,528 B2
(45) Date of Patent: Mar. 17, 2020

(54) PEAK ASSESSMENT FOR MASS SPECTROMETERS

(71) Applicant: Micromass UK Limited, Wilmslow (GB)

(72) Inventors: Richard Denny, Newcaste-under-Lyme (GB); Paul Slater, New Mills (GB)

(73) Assignee: MICROMASS UK LIMITED, Wilmslow (GB)

( * ) Notice: Subject to any disclaimer, the term of this patent is extended or adjusted under 35 U.S.C. 154(b) by 402 days.

(21) Appl. No.: 15/023,549

(22) PCT Filed: Sep. 17, 2014

(86) PCT No.: PCT/GB2014/052813

§ 371 (c)(1),
(2) Date: Mar. 21, 2016

(87) PCT Pub. No.: WO2015/040381

PCT Pub. Date: Mar. 26, 2015

(65) Prior Publication Data

US 2016/0217986 A1 Jul. 28, 2016

(30) Foreign Application Priority Data

Sep. 23, 2013 (EP) ..... 13185613
Sep. 23, 2013 (GB) ..... 1316876.0

(51) Int. Cl.
*H01J 49/00* (2006.01)

(52) U.S. Cl.
CPC ..... *H01J 49/0036* (2013.01)

(58) Field of Classification Search
CPC ..... H01J 49/0036
See application file for complete search history.

(56) References Cited

U.S. PATENT DOCUMENTS 5,397,899 A * 3/1995 DiFoggio ..... G01N 21/35 250/339.09
6,745,133 B2 6/2004 Axelsson
7,396,688 B2 7/2008 Estell et al.
7,982,181 B1 * 7/2011 Senko ..... G01N 30/72 250/281
8,078,427 B2 12/2011 Tischler et al.
(Continued)

FOREIGN PATENT DOCUMENTS

GB 2401721 11/2004
WO 2013/0104004 7/2013

*Primary Examiner* — Hyun D Park

(57) ABSTRACT

A method of assessing mass spectral peaks obtained by a mass spectrometer is disclosed. The method comprises: providing mass spectral data; selecting a chemical compound thought to have been analysed to provide said experimentally observed data, and modelling the spectral data predicted to be detected if the compound was to be mass analysed. Modelling comprises: generating a first set of spectral data including at least one mass peak that is predicted to be detected for the selected compound; generating a second set of spectral data by duplicating at least part of the first set of spectral data and shifting at least one mass peak in mass to charge ratio relative to the corresponding at least one mass peak in the first set of spectral data; and summing the amplitudes of the first and second sets of spectral data to produce a model data set having at least one mass peak.

14 Claims, 8 Drawing Sheets

(56) References Cited

U.S. PATENT DOCUMENTS

| | | | | |
|---|---|---|---|---|
| 8,927,925 | B2 | 1/2015 | Kuehl et al. | |
| 2002/0072064 | A1 | 6/2002 | Naki et al. | |
| 2002/0172961 | A1* | 11/2002 | Schneider | C12Q 1/6872 435/6.12 |
| 2005/0080571 | A1* | 4/2005 | Klee | H01J 49/0031 702/32 |
| 2005/0255606 | A1 | 11/2005 | Ahmed et al. | |
| 2009/0302213 | A1 | 12/2009 | Kuehl et al. | |
| 2013/0191033 | A1* | 7/2013 | Morgner | H01J 49/0036 702/19 |

* cited by examiner

PEAK ASSESSMENT FOR MASS SPECTROMETERS

The present invention relates to an automated method of assessing mass peaks and a mass spectrometer configured to perform said method.

CROSS-REFERENCE TO RELATED APPLICATIONS

This application is the National Stage of International Application No PCT/GB2014/052813, filed 17 Sep. 2014 which claims priority from and the benefit of United Kingdom patent application No. 1316876.0 filed on 23 Sep. 2013 and European patent application No. 13185613.0 filed on 23 Sep. 2013. The entire contents of these applications are incorporated herein by reference.

BACKGROUND OF THE PRESENT INVENTION

Prior to use in analysing analytical samples, it is important for a quadrupole mass spectrometer to be assessed in order to check that mass spectral peaks of sufficient quality can be obtained. If the quality of mass peaks across a mass range is not sufficient, it may indicate that there were defects in the manufacture of the mass spectrometer or that it has not been tuned correctly. The current process for performing the above assessment is laborious and is also subjective, as it relies relatively heavily on human analysis.

It is therefore desired to provide an improved method of assessing mass spectral peaks. It is particularly desirable to provide an automated peak shape analysis tool that can consistently and rapidly assesses whether a mass spectrometer (e.g. a quadrupole mass spectrometer) has been tuned correctly and/or has any manufacturing defects.

SUMMARY OF THE PRESENT INVENTION

The present invention provides a method of assessing mass spectral peaks obtained by a mass spectrometer comprising:

providing experimentally obtained mass spectral data;

selecting a chemical compound thought to have been analysed so as to provide said experimentally observed data, and modelling the spectral data predicted to be detected if the compound was to be mass analysed, wherein said step of modelling comprises:

generating a first set of spectral data including at least one mass peak that is predicted to be detected for the selected compound;

generating a second set of spectral data by duplicating at least part of the first set of spectral data and shifting at least one mass peak in mass to charge ratio relative to the corresponding at least one mass peak in the first set of spectral data; and summing the amplitudes of the first and second sets of spectral data to produce a model data set having at least one mass peak;

said method further comprising comparing the model data set to the experimentally obtained data;

determining that the model data set matches the experimentally obtained mass spectral data; and identifying a feature or peak of the experimentally obtained data from the first and/or second sets of data.

The present invention provides a simple and convenient way to automatically detect a feature or peak in an experimentally obtained mass spectrum. The present invention is therefore particularly useful in modelling and identifying the effects on a mass spectrum of defects in a mass spectrometer or of poor tuning of the mass spectrometer. The present invention may also be used to model peaks for use in mass measurement, e.g. through peak deconvolution.

The feature or peak of said experimentally obtained data may be identified from the relative locations of the first and second sets of data.

Preferably, the step of providing the experimentally obtained mass spectral data comprises mass analysing at least one compound in a mass spectrometer. Said selected chemical compound that is used to model the spectral data is preferably the same chemical compound as the compound that is mass analysed in the spectrometer.

Preferably, the step of modelling the spectral data predicted to be detected if the compound was to be mass analysed comprises modelling the plural mass peaks that would be detected if the compound contained multiple different isotopes of one or more of the chemical elements in the compound, such that the first set of spectral data includes a plurality of mass peaks.

The second set of spectral data preferably includes said plurality of mass peaks, wherein each of the plurality of mass peaks in the second set of spectral data is shifted in mass to charge ratio relative to the corresponding mass peak in the first set of spectral data.

The mass peak(s) in the second set of mass spectral data are preferably shifted to lower mass to charge ratios relative to their corresponding mass peak(s) in the first set of mass spectral data.

The step of generating the first set of spectral data preferably comprises predicting the mass to charge ratio of said at least one mass peak that is predicted to be detected for the selected compound, and applying a peak shape to each of the at least one peaks.

The peak shape may be a Gaussian function or a quadratic function. Alternatively, a first mathematical function may be convolved with a second mathematical function in order to generate the peak shape. Preferably, the first mathematical function is a Gaussian and the second mathematical function is a quadratic.

The first set of spectral data preferably includes a plurality of mass peaks, wherein the peak shape of each of the plurality of peaks is a convolved function of a first mathematical function (e.g. Gaussian) and a second mathematical function (e.g. quadratic), wherein the peak shape of a peak at low mass to charge ratio is determined from the convolved function of a first mathematical function (e.g. Gaussian) having a small width and a second mathematical function (e.g. quadratic) having a larger width, and wherein the peak shape of a peak at high mass to charge ratio is determined from the convolved function of a first mathematical function (e.g. Gaussian) having a large width and a second mathematical function (e.g. quadratic) having a smaller width or a delta function.

Preferably, the first and second sets of spectral data have the same number of peaks.

Preferably, the peaks in the first and second sets of spectral data are spaced apart in mass to charge ratio by the same spacing. For example, the peaks in the first set of spectral data may be in the same locations as the peaks in the second set of spectral data, except wherein all of the peaks in the second set of spectral data are shifted by the same mass to charge ratio relative to the peaks in the first set of spectral data.

Each peak in the second set of spectral data may have a different amplitude to its corresponding peak in the first set of spectral data; or at least one of the peaks in the second set of spectral data may have a different amplitude to its corresponding peak in the first set of spectral data.

Alternatively, or additionally, each peak in the second set of spectral data may have a different shape to its corresponding peak in the first set of spectral data; or wherein at least one of the peaks in the second set of spectral data may have a different shape to its corresponding peak in the first set of spectral data.

Preferably, the method comprises generating a plurality of sets of first spectral data, wherein at least some of the corresponding peaks in the different sets of first spectral data have different amplitudes and/or different peak shapes, the method further comprising generating said second set of spectral data for each one of said sets of first spectral data, the method further comprises summing the amplitudes of the mass peak(s) each set of first mass spectral data with the amplitudes of the mass peak(s) in its corresponding second set of spectral data so as to provide a plurality of summed model data sets, comparing each set of summed model data to the experimentally obtained data; and determining the model data set that best matches the experimentally obtained mass spectral data; and identifying a feature or peak of the experimentally obtained data from the first and/or second sets of data in the best matching model data.

Preferably, said step of identifying a feature or peak of the experimentally obtained data comprises: determining that the amplitude of the summed model data set has a minimum or trough located between a first mass peak in the first set of spectral data and a corresponding first mass peak in the second mass spectral data, wherein a portion of the experimentally obtained data having a mass range equivalent to the mass range of the first or second mass peak on either side of the minimum is considered or indicated as being a defect in the experimentally obtained data. This may be known as a precursor peak defect.

Preferably, the lowest mass range of the two first mass peaks is considered to be equivalent to the mass range of the defect in the experimentally obtained data.

Said step of identifying a feature or peak of the experimentally obtained data comprises: determining that a first peak of the first data set only partially overlaps with a corresponding first peak of the second data set, and determining that the amplitude of the summed model data set does not have a minimum or trough located between the two first peaks, wherein the mass range of the non-overlapping portion of the first peak of the first data set or the mass range of the non-overlapping portion of the first peak of the second data set is considered or indicated as being the mass range of the experimentally obtained data that contains a defect. This may be known as a shoulder defect.

Preferably, the lowest mass range of the two first mass peaks is considered to be equivalent to the mass range of the defect in the experimentally obtained data.

The present invention also provides a method of correcting, adjusting or tuning a mass spectrometer comprising any one of the methods described above, wherein the step of identifying a feature or peak of the experimentally obtained data comprises identifying a defect in the experimentally obtained data.

Predetermined different types of defect and/or predetermined different sources of defect may be associated with different data model sets, and the method may determine the most likely data model set to match the experimentally obtained data and then signal the associated type and/or source of defect to the operator.

The method may further comprise tuning or adjusting the mass spectrometer such that the defect is eliminated when the mass spectrometer subsequently analyses said compound.

The present invention also provides a mass spectrometer arranged and configured with control means so as to perform any one of the methods described above.

Preferably, the mass spectrometer comprises a miniature mass spectrometer.

The preferred embodiment is particularly advantageous in quadrupole mass spectrometers, for example, in order to determine defects in the manufacture of the quadrupole arrangement. However, the present invention is also useful in other types of mass spectrometer.

The mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and an orbitrap (RTM) mass analyser comprising an outer barrel-like electrode and a coaxial inner spindle-like electrode, wherein in a first mode of operation ions are transmitted to the C-trap and are then injected into the orbitrap (RTM) mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the orbitrap (RTM) mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The mass spectrometer may further comprise a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

The assessment of peak shape is an important part of the quality control process in the manufacture of mass spectrometers, such as quadrupole mass spectrometers and other types of mass spectrometer. The present invention can also be used to identify peaks, other than in a quality control aspect. It is therefore desired to provide a model for modelling mass spectral peaks.

Figure 1A:
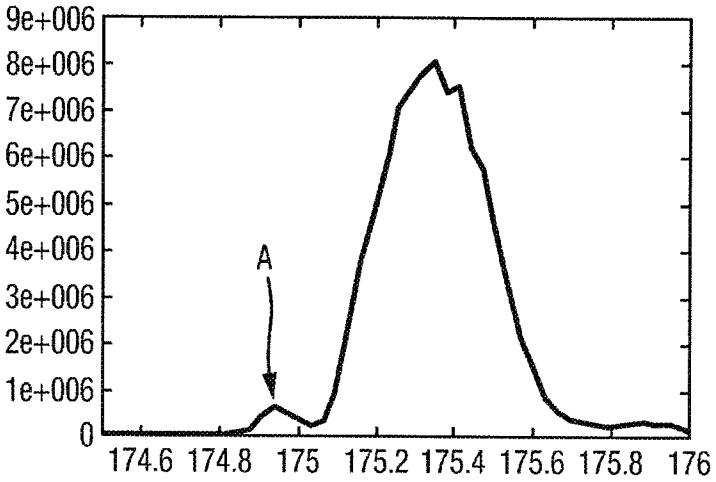
FIGS. 1A to 1D show various defects in experimentally obtained mass spectrums.
Figure 1B:
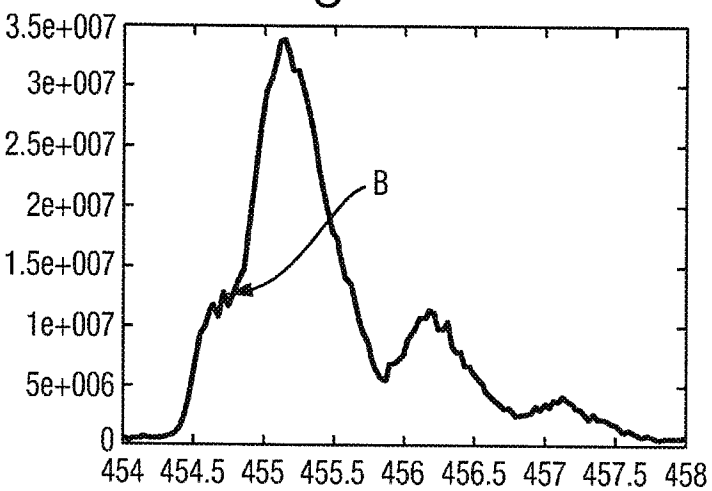
Figure 1C:
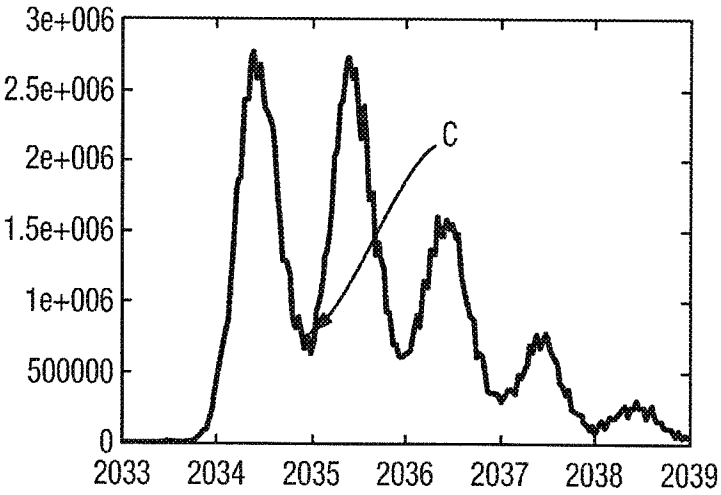
Figure 1D:
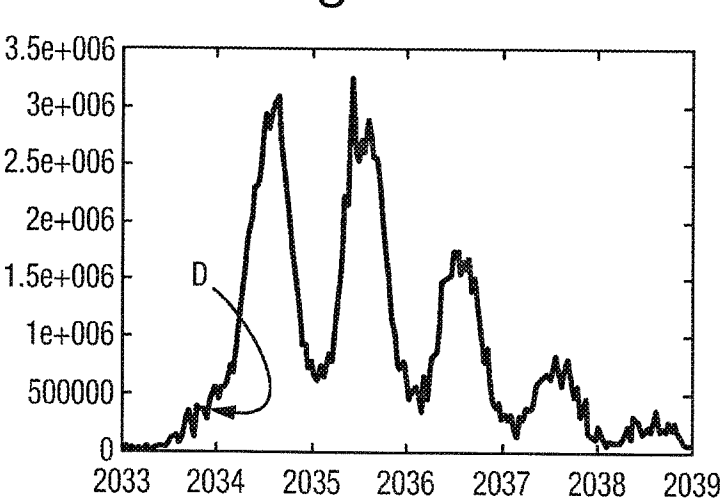

FIG. 1A to 1D show defects that may be observed in mass spectra if the mass spectrometer has a defect or is not tuned properly. FIG. 1A shows an example of a precursor defect (A), exhibited by a precursor peak erroneously appearing at a lower mass value than the main peak. Such a defect may occur, for example, in a quadrupole mass spectrometer due to mis-focussing of the quadrupole, resulting in an early peak before the main peak. FIG. 1B shows an example of a shoulder defect (B), in which a side of a peak may include an erroneous shoulder portion, due to a defect in the mass spectrometer or due to the instrument being poorly tuned. FIG. 1C shows an example of a defect (C) in which the magnitude of the valley between two peaks is erroneously high due to a defect in the mass spectrometer or due to the instrument being poorly tuned. FIG. 1D shows another example of a shoulder defect (D), due to a defect in the mass spectrometer or due to the instrument being poorly tuned.

Figure 2:
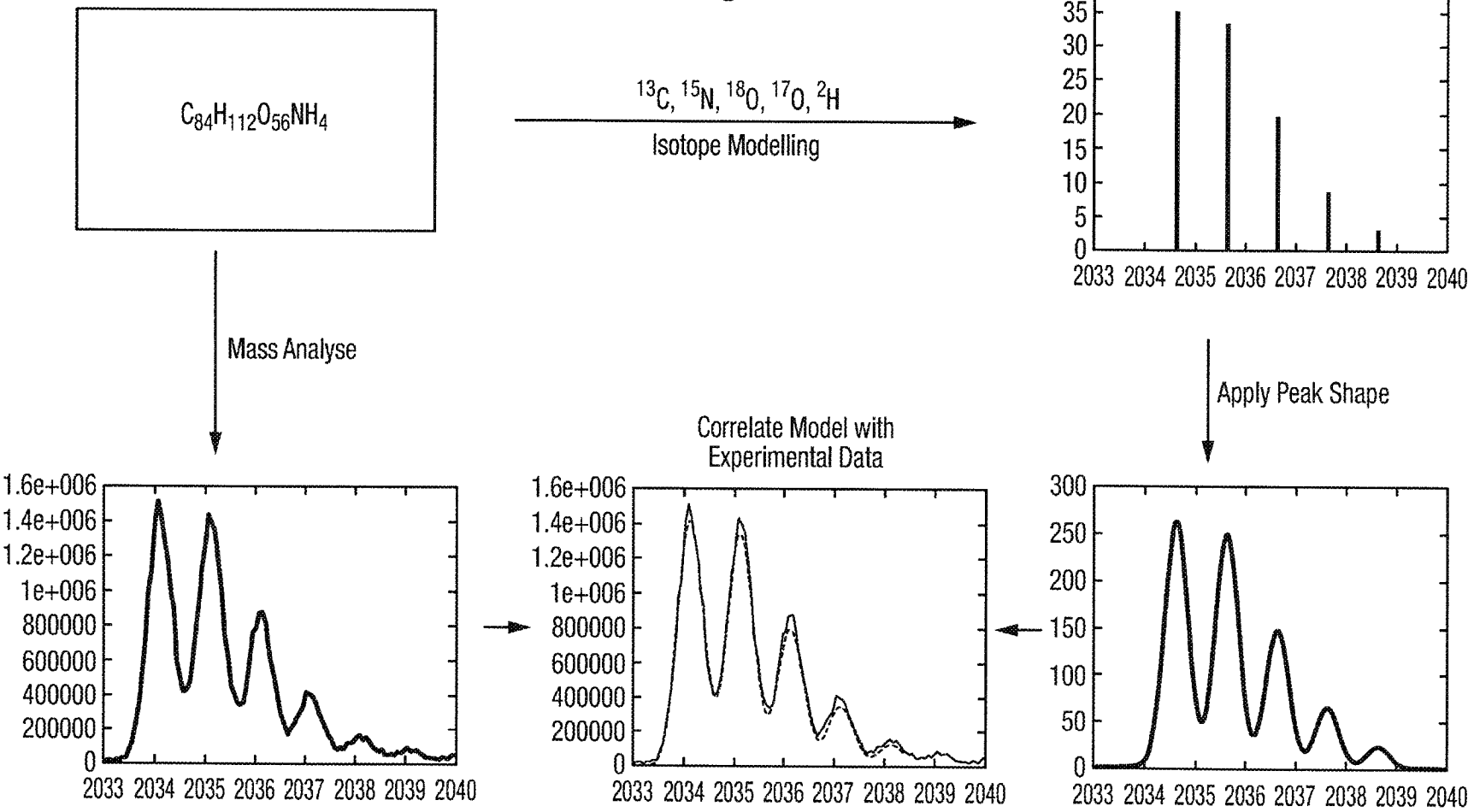
FIG. 2 shows a flow chart according to a preferred embodiment of the present invention for modelling a mass spectrum of a known compound.

FIG. 2 shows a flow chart of a preferred method for modelling ion spectra which are experimentally observed. In the example depicted, the chemical being studied is $C_{84}H_{112}O_{56}NH_4$. The chemical is subjected to mass spectrometry and produces the spectrum shown in the bottom left corner of the figure.

The chemical is also subjected to theoretical modelling so as to determine the spectrum that might be expected if the chemical was analysed. Although the chemical has a single mono-isotopic mass of 2034.63 it will not simply produce a single mass peak, because the chemical elements making up the chemical have different isotopes. As different molecules of the chemical will include different isotopes of the same chemical elements, the different molecules will have different masses. Also, the abundance of the various isotopes may be different for different chemical elements. The method undergoes isotope modelling in order to account for the presence of different isotopes in different molecules of the same chemical. In the example shown in FIG. 2 the isotope modelling step accounts for the possibility that the chemical molecules may include the most common (i.e., standard) isotones of the chemical elements in addition to the isotones $^{13}C$, $^{15}N$, $^{18}O$, $^{17}O$ and $^{2}H$. As such, the model predicts the detection of several discrete delta function mass peaks for the analysis of $C_{84}H_{112}O_{56}NH_4$, as shown in the top right corner of FIG. 2.

Figure 3A:
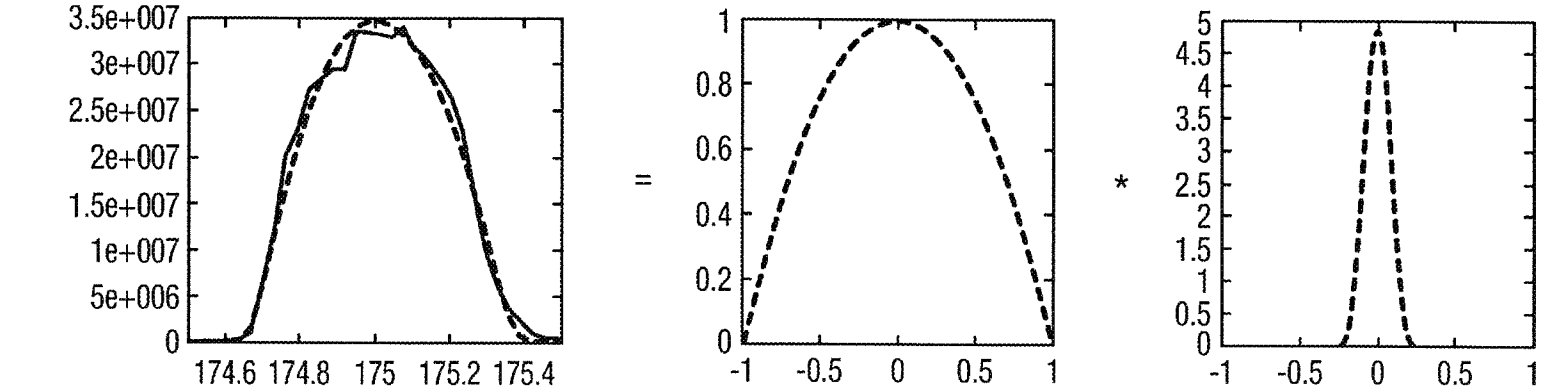
FIGS. 3A and 3B show how the shapes of spectral peaks of low and high mass, respectively, may be modelled using mathematical functions.
Figure 3B:
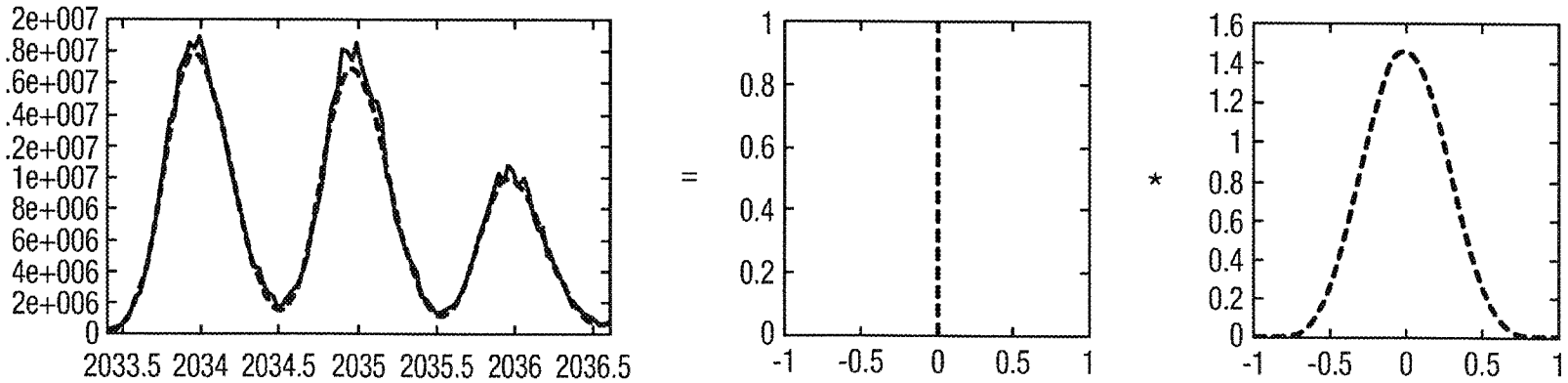

The model then applies a peak shape to each of the delta function peaks, in a manner such as that described in relation to FIGS. 3A and 3B. The model then provides a model spectrum as shown in the bottom right corner of FIG. 2.

The model spectrum is then compared to the experimentally observed spectrum (bottom left corner of FIG. 2) in order to correlate the model spectrum with the experimentally observed spectrum. This correlation is depicted in the bottom, central diagram of FIG. 2. If the two spectra are substantially the same, as in the example in FIG. 2, then there are no defects in the mass spectrometer or in the tuning of the mass spectrometer. The model can therefore be used to identify correct features of the experimentally observed spectrum.

The model preferably accounts for variations in peak shape which may vary with, for example, mass to charge ratio. Peaks at low mass to charge ratios barely have any tails on either side of the peak, whereas peaks at high mass to charge ratios do tend to have tails on either side of the peak. Peaks may also have some intrinsic asymmetry, which may be modelled. FIGS. 3A and 3B show examples of the shapes of peaks at different mass to charge ratios and how these peak shapes may be modelled.

FIG. 3A shows three graphs relating to the modelling of a peak of relatively low mass to charge ratio. The left graph shows a jagged plot representing an experimentally observed peak of low mass to charge ratio, and also shows a smooth plot representing a theoretically modelled peak of low mass to charge ratio. As described above, experimentally observed peaks of low mass to charge ratio should barely have tails on either side of the peak. The peaks are therefore relatively well represented by a quadratic function, as shown in the central graph of FIG. 3A. However, such peaks do have a small tail on each side, which is not represented by such a quadratic function. Such tails can be modelled by a Gaussian function, as shown in the right graph in FIG. 3A. The quadratic and Gaussian functions can be convolved in order to model the peak shape at low mass to charge ratio. The resulting convolved function is the peak shape shown as the smooth plot in the left graph of FIG. 3A. As can be seen from the left graph, the modelled and experimentally observed peaks closely match.

FIG. 3B shows three graphs relating to the modelling of a chemical with relatively high mass to charge ratio. The left graph shows a jagged plot representing experimentally observed peaks for the chemical, and also shows a smooth plot representing theoretically modelled peaks for the chemical. Chemicals of higher mass contain more atoms and more types of ions than lighter chemicals, and are therefore susceptible to containing more different isotopes of chemical elements. Higher mass chemicals therefore tend to produce mass spectra having a larger number of peaks, as can be seen by comparing the left graphs of FIG. 3A and FIG. 3B. The presence of each of these peaks can be represented by a delta function as shown in the central graph of FIG. 3B. As described above, experimentally observed peaks of high mass to charge ratio tend to have relatively large tails on either side of the peak. The peaks are therefore represented well by a Gaussian function, as shown in the right graph of FIG. 3B. The delta and Gaussian functions can be convolved in order to model the peak shapes at high mass to charge ratio. The resulting convolved function is the spectrum shown as the smooth plot in the left graph of FIG. 3B. As can be seen from the left graph, the modelled and experimentally observed peaks closely match.

It will be apparent that the peak shapes can be applied to the theoretical model described in relation to FIG. 2. For a peak at a given mass to charge ratio, the relative widths of the two peak shapes being convolved (e.g. quadratic and Gaussian) can be adjusted so as to achieve whatever mix is appropriate for that mass to charge ratio. For example, at low mass to charge ratio peaks the width of the quadratic function is selected to be greater than the width of the Gaussian function, and at high mass to charge ratio peaks the width of the quadratic function may be selected to be reduced smaller than the width of the quadratic function. At very high mass to charge ratios the Gaussian function may be convolved with a narrow stick or delta function.

The above described method illustrates how to model mass spectral peaks obtained from a mass spectrometer that does not have defects and which is properly tuned. The preferred embodiment is able to detect defects in an experimentally obtained mass spectrum by modelling the effects of defects on the spectral data, and by comparing the modelled data to the experimentally obtained data. Probabilistic methods may be used to obtain the best fitting model, such as Bayesian analysis techniques. Such defects may be due to defects in the manufacture of the mass spectrometer or due to poor tuning of the spectrometer. The method may then indicate the defect to a user and possibly the manner of correction of the defect.

In order to model defects that may appear in mass spectra, the preferred embodiment generates a first set of spectral data (i.e. a first mass spectrum) for a given compound, e.g. as described in FIG. 2. The method then generates a second set of spectral data (i.e. a second mass spectrum) that has substantially the same number and spacing of peaks as the first set of spectral data, except that the mass locations of the peaks in the second set of spectral data are shifted relative to the mass locations of the peaks in the first set of spectral data. The shapes and amplitudes of the peaks in the second set of spectral data may also be varied relative to the shapes and amplitudes of the peaks in the first set of spectral data. The first and second sets of spectral data (i.e. the first and second mass spectra) are then summed to produce an overall model data set (i.e. a summed spectrum). The overall model data set, i.e. the summed spectrum, is compared to the experimentally observed spectral data to determine if it matches. The parameters of the first and/or second sets of spectral data may be altered until the overall model data set matches the experimental data. For example, the amount by which the mass locations of the peaks in the second set of spectral data are shifted relative to the mass locations of the peaks in the first set of spectral data may be varied. The peak shapes and/or amplitudes and/or widths of the first and/or second sets of spectral data may be varied. Probabilistic methods may be used to determine which first and second sets of spectral data, when summed, most closely match the experimentally obtained data. The location, type and potentially the source of the defect can then be determined from the relationship between the first and second sets of spectral data that, when summed, match the experimentally obtained data.

Figure 4A:
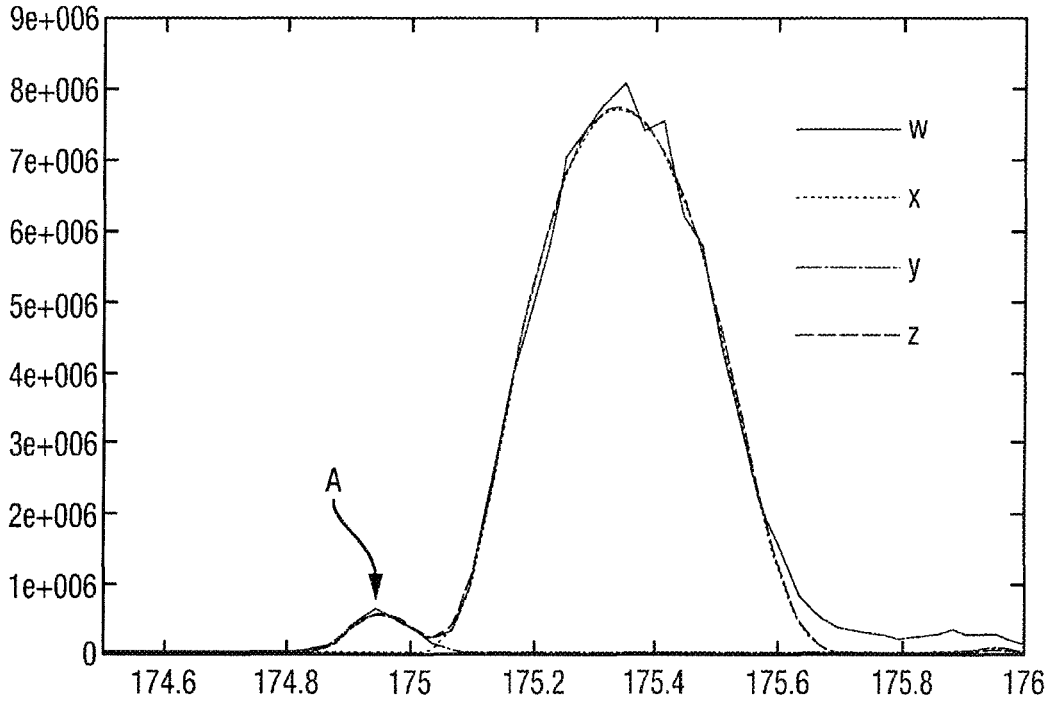
FIGS. 4A to 4D show how the defects observed in FIGS. 1A to 1D may be detected by modelling according to preferred embodiments of the present invention.

FIG. 4A shows how the model of a preferred embodiment is used to determine the presence of a precursor peak defect (A) in an experimentally observed spectrum. The plot w shows the experimentally observed spectrum, which corresponds to that shown in FIG. 1A. The plot x shows a first set of spectral data that consists of a single peak. The plot y shows a second set of spectral data that consists of a single peak corresponding to the single peak of the first set of spectral data, except shifted to lower mass and having a smaller amplitude. The plot z shows the overall model data set, which is the sum of the first and second sets of spectral data. It will be observed that the spectrum of the overall model data set matches very well with the experimentally obtained spectrum and so it is assumed to be the correct model. A precursor defect is identified by the existence of a minimum in the spectrum for the overall data set between a mass peak in the first set of spectral data and a corresponding mass peak of the second set of spectral data. As this feature is present in FIG. 4A, it is therefore determined that the experimentally observed spectrum is suffering from a precursor defect at the location indicated.

Figure 4B:
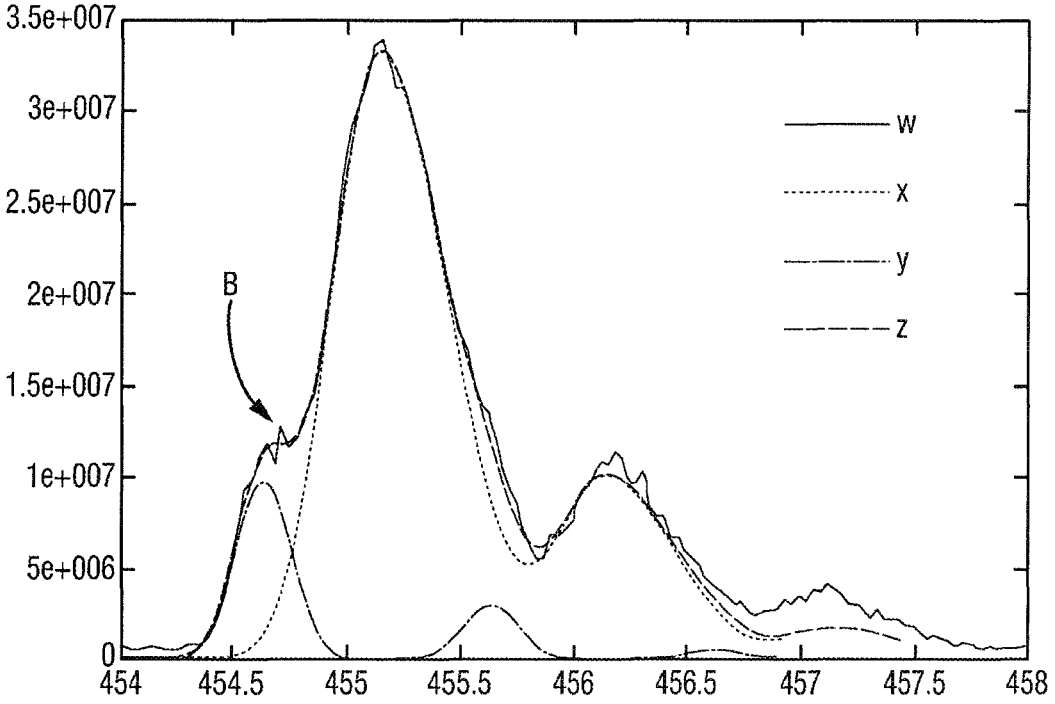

FIG. 4B shows how the model of a preferred embodiment is used to determine the presence of a shoulder defect (B) in an experimentally observed spectrum. A shoulder defect is similar to the above-described precursor defect, except that the precursor peak is partially merged with the main peak so as to form a shoulder on the main peak. The plot w in FIG. 4B shows the experimentally observed spectrum, which corresponds to that shown in FIG. 1B. The plot x shows a first set of spectral data that consists of multiple isotope peaks. The plot y shows a second set of spectral data that consists of multiple isotope peaks that correspond to the peaks of the first set of spectral data, except shifted to lower mass and having a smaller amplitude. The plot z shows the overall model data set, which is the sum of the first and second sets of spectral data. It will be observed that the spectrum of the overall data set matches very well with the experimentally obtained spectrum and so it is assumed to be the correct model. The method seeks to identify a shoulder by identifying the absence of a precursor defect, i.e. there is no minimum in the spectrum of the overall data set between a mass peak in the first set of spectral data and a corresponding mass peak of the second set of spectral data. The shoulder defect is then identified by the existence of a peak of the second set of spectral data (plot y) that only partially overlaps with a peak of the first set of spectral data (plot x), and wherein the amplitude of the peak of the second set of spectral data (plot y) exceeds the amplitude of the corresponding peak of the first set of spectral data (plot x). A shoulder defect may be determined to be present when the partially overlapping peak of the second set of spectral data (plot y) is at a lower mass to charge ratio than the peak of the first set of spectral data (plot x) that it partially overlaps with. As this feature is present in FIG. 4B, it is therefore determined that the experimentally observed spectrum is suffering from a shoulder defect at the point indicated.

Figure 4C:
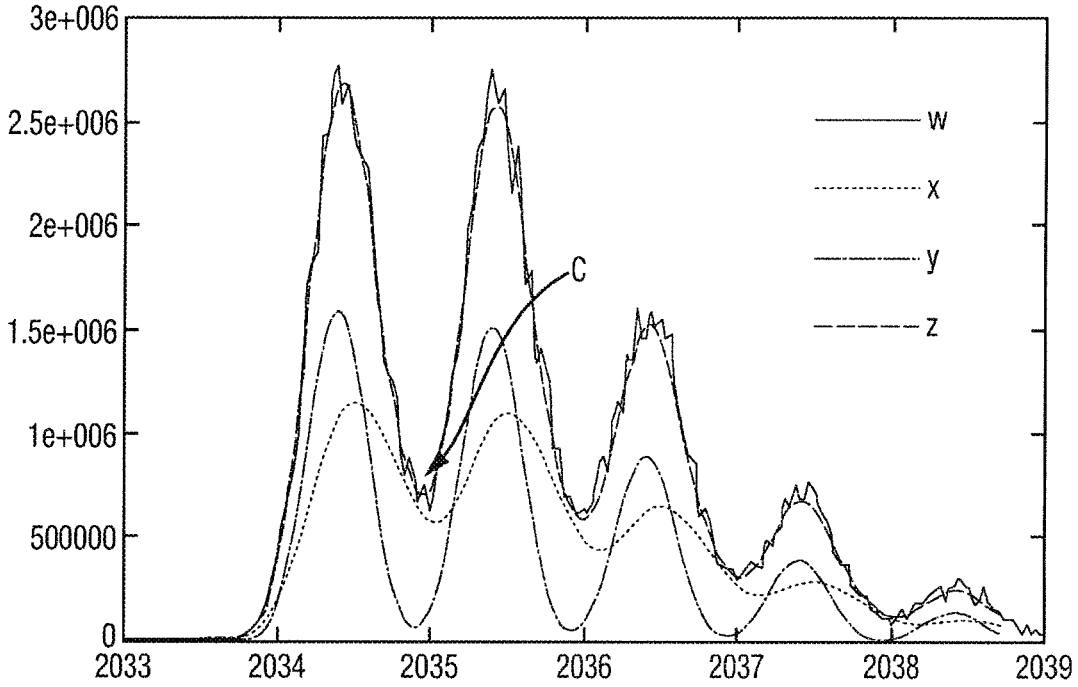

FIG. 4C shows how the model of a preferred embodiment is used to determine the presence of a defect C when the valley between two peaks in an experimentally observed spectrum is too high. The plot w shows the experimentally observed spectrum, which corresponds to that shown in FIG. 4C. The plot x shows a first set of spectral data that consists of multiple peaks. The plot y shows a second set of spectral data that consists of multiple peaks corresponding to the peaks of the first set of spectral data, except shifted to lower mass and having a smaller amplitude. The plot z shows the overall data set, which is the sum of the first and second sets of spectral data. It will be observed that the spectrum of the overall data set matches very well with the experimentally obtained spectrum and so it is assumed to be the correct model. The high valleys between the peaks in the overall data set is already apparent and can be determined from the overall data set alone, i.e. without the modelling of the preferred method. However, modelling the data to determine which first and second sets of spectral data match the overall data set can be useful in order to determine the source of the defect. The source of the defect can be determined from the relationship between the first and second data sets that match the overall data set.

Figure 4D:
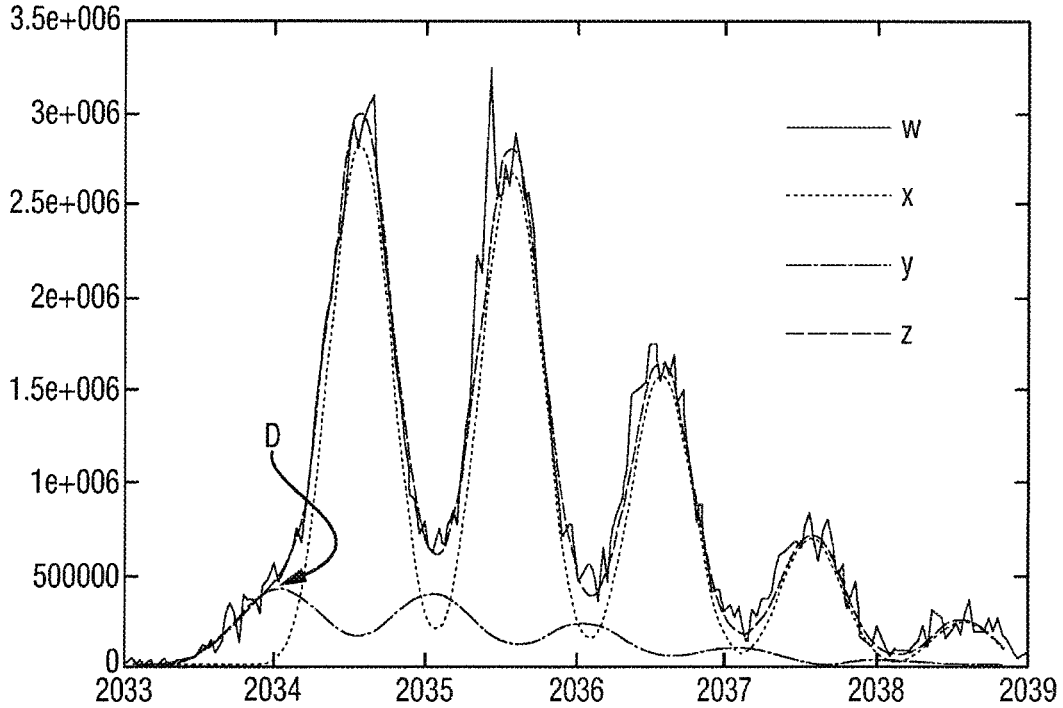

FIG. 4D shows a plot w indicating an experimentally observed spectrum, which corresponds to that shown in FIG. 1D. FIG. 4D shows how the model of a preferred embodiment is used to determine the presence of a shoulder defect D. The technique is therefore substantially the same as that described above in relation to FIG. 4B. However, it will be appreciated that the shoulder defect in the experimentally observed spectrum is less apparent in FIG. 4D than it is in FIG. 4B. This highlights the usefulness of the present invention, as compared conventional defect detection techniques, which are unlikely to spot the shoulder defect modelled in FIG. 4D.

More general information useful for understanding the preferred embodiments of the present invention will now be described.

As described above, the preferred modelling method applies peak shapes to the modelled spectral data. Mathematical explanations of these techniques follow. At high mass to charge ratios, the mass spectral peak tends to be of Gaussian form. In this context, Gaussians are inconvenient mathematically as they extend over an infinite range. An approximation to a Gaussian given finite support is the following function:

$$g(x; N) = \left\{ \begin{matrix} (1-x^2)^N, & x \in [-1, 1] \\ 0, & x \notin [-1, 1] \end{matrix} \right\}.$$

A Gaussian form emerges in the limit, specifically, $$\lim_{N \to \infty} g(x; N) = e^{Nx^2},$$

however, N≥6 gives an adequate approximation, with the full width at half maximum being given by:

$$FWHM(N) = 2\sqrt{1 - \left(\frac{1}{2}\right)^{\frac{1}{N}}}.$$

Figure 5:
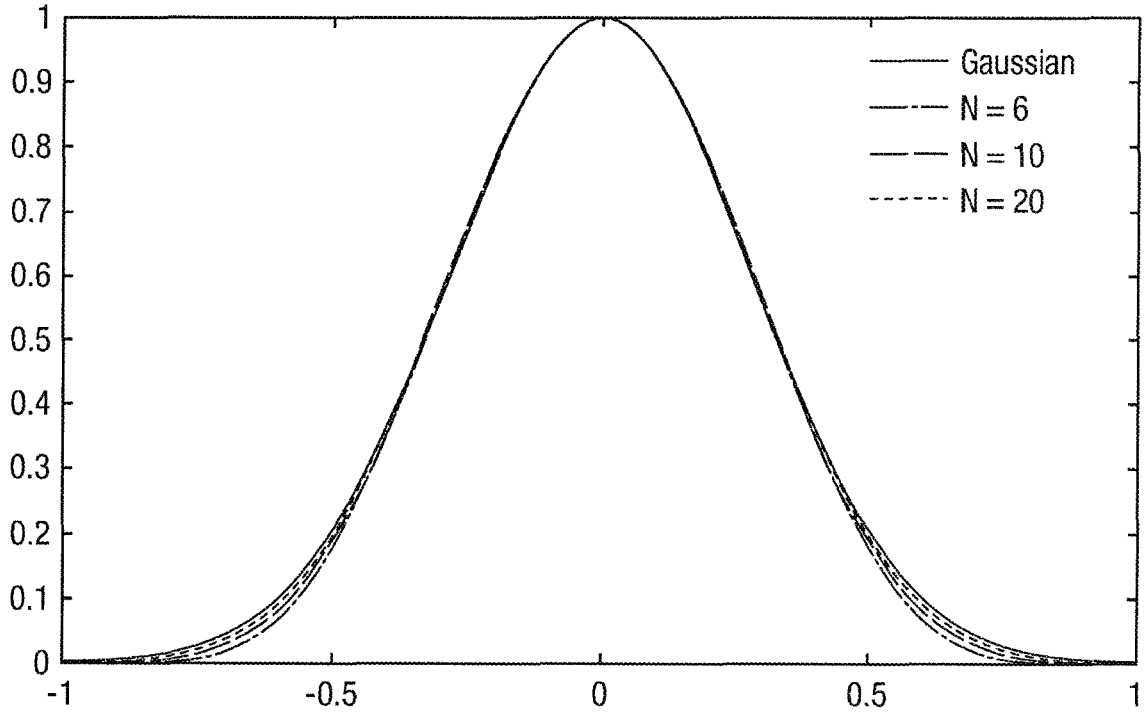
FIG. 5 shows various mathematical approximations to a Gaussian curve.

FIG. 5 shows a Gaussian plot (plot x) and also shows approximations to a Gaussian for values of N=6, 10 and 20 with matched full widths at half maximum.

In contrast to the Gaussian type mass spectral peaks observed at high mass to charge ratios, mass spectral peaks at low mass to charge ratios barely have any tails and so they plausibly tend to the quadratic form. This quadratic form may be expressed by the following:

$$q(x) = \left\{ \begin{matrix} 1-x^2, & x \in [-1, 1] \\ 0, & x \notin [-1, 1] \end{matrix} \right\}.$$

Figure 6:
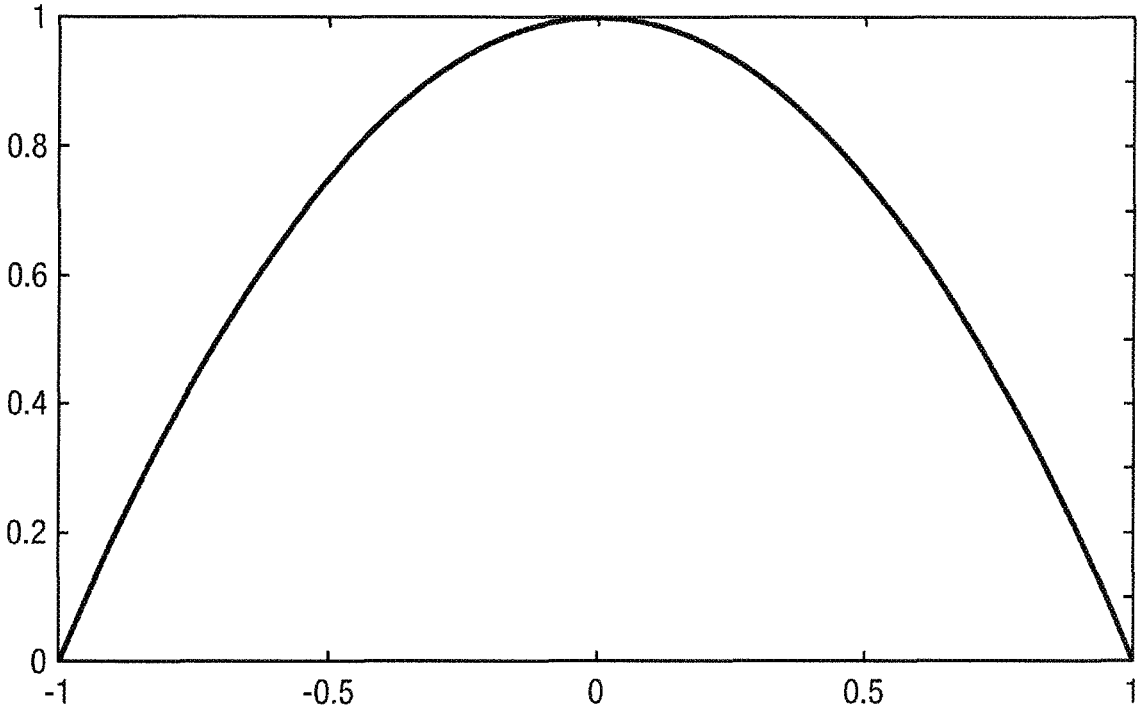
FIG. 6 illustrates a quadratic function.

FIG. 6 shows an example of a quadratic plot that is representative of spectral peaks at low mass to charge ratios having no tails.

The peak shape for ions at intermediate mass to charge ratios can be expressed as a convolution of the Gaussian function described above in respect of high mass to charge ratios and the quadratic function expressed above for low mass to charge ratios.

First, a control of the width of the quadratic for low mass to charge ratios is introduced by specifying the extent of the support for the quadratic, as can be seen by the following expression:

$$q(x; h) = \left\{ \begin{matrix} 1 - \left(\frac{x}{h}\right)^2, & x \in [-h, h] \\ 0, & x \notin [-h, h] \end{matrix} \right\},$$

The Gaussian and quadratic functions may then be combined through convolution to achieve a function for appropriate peak shapes for intermediate masses. The convolution of the two forms is as follows:

$$f(x; h, N) = \int_{-\infty}^{\infty} g(t; N)\left(1 - \left(\frac{x-t}{h}\right)^2\right) dt =$$

-continued $$\left(1 - \left(\frac{x}{h}\right)^2\right) \int_{x-h}^{x+h} g(t; N)\, dt + 2\frac{x}{h^2} \int_{x-h}^{x+h} t g(t; N)\, dt - \frac{1}{h^2} \int_{x-h}^{x+h} t^2 g(t; N)\, dt.$$

It will be appreciated that the convolution acts to sum the Gaussian and quadratic functions, wherein each time the two functions are summed they are at different displacements from each other. For example, if one was to calculate the convolution where x=0.5 and the Gaussian is considered to be centred at x=0.5, then for each displacement t away from X=0.5, the value of the quadratic at x−t would be multiplied with the value of the Gaussian at t. The products for all the different displacements t are summed to give convolved function. It will therefore be appreciated that the parameter t in the above equation is akin to the parameter x.

The integrals are readily evaluated, as g(t; N) is a low order polynomial, as are the derivatives. The resulting peak width at half maximum can easily be found using a root finding method. Overall control of peak width can be achieved by scaling x to the required support of g(x; N). Including normalisation, we finally arrive at, $$f(x; w, h, N) = f\left(\frac{x}{w}; h, N\right) \Big/ Z.$$

where w is the width of the approximation to a Gaussian (i.e. w defines the finite range of the Gaussian). Z is the normalising constant, which is the product of the integrals of the convolved functions, and which is expressed by the following expression:

$$Z = 2h \int_0^1 1 - t^2\, dt \times 2w \int_0^1 g(u; N)\, du = \frac{8}{3} hw \sum_{n=0}^{N} \frac{(-1)^n}{2n+1} \binom{N}{n}.$$

As spectral data are accumulated on a grid of finite cell size, it is really the difference in the cumulant of the peak shape function at the cell boundaries which should be used to model the data. The following expression is therefore relevant:

$$f_i = \int_{x_i - x_c}^{x_{i+1} - x_c} f(t; w, h, N)\, dt,$$

where $f_i$ is the response of the peak in the i th cell and $x_c$ is the centre position of the peak. This digitisation may not matter unless the peak width is less than a couple of cell widths.

Figure 7:
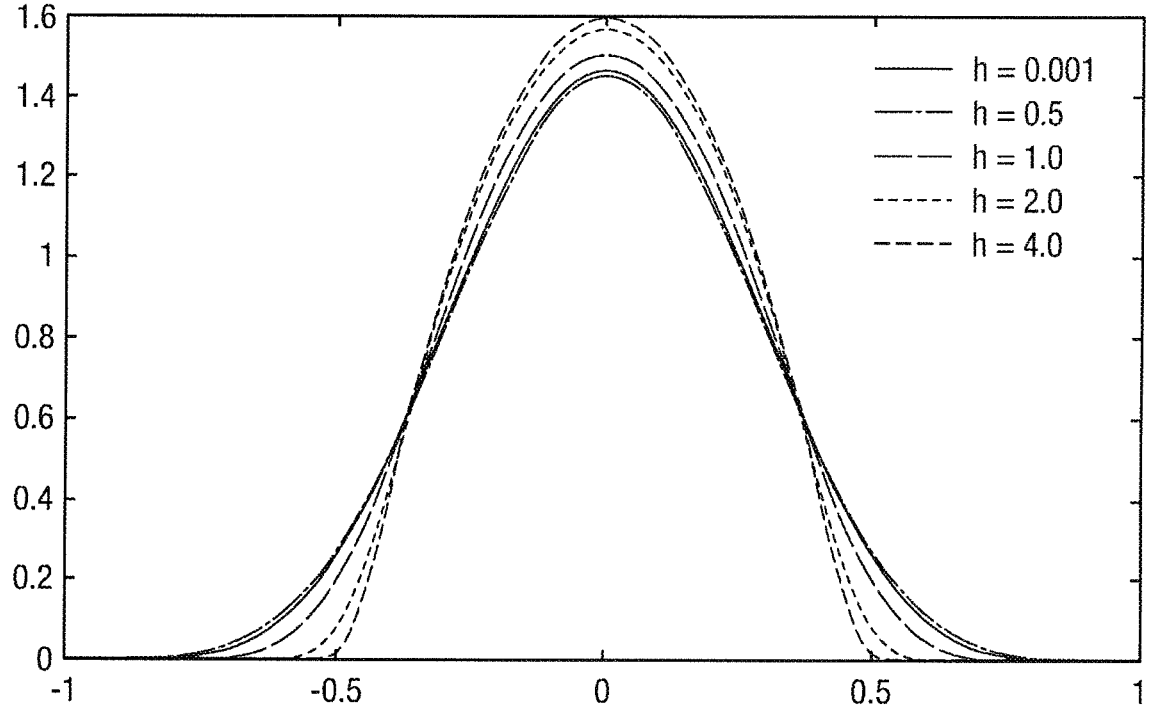
FIG. 7 shows a family of spectral peaks having the same FWHM.

FIG. 7 shows an example of a family of peak shapes of constant FWHM, with h=0.001, 0.5, 1.0, 2.0 and 4.0. The peak heights differ due to normalisation.

As discussed above, Bayesian analysis may be used in order to determine which configurations of model for the peak shapes are more likely to be correct. Bayesian analysis combines what was known before the data were inspected with what information the data provides in a coherent manner. Prior knowledge is embodied in the model of the system being examined and the prior probability distribution of any model variables. The data inform the model via a likelihood function (also part of the prior knowledge). This can be summarised in the following equation, $$\text{“}Pr\text{”}\ (\text{“Mode”}i\ X_{\downarrow}k|\text{“Data”})=(Pr(\text{“Model”}\ X_{\downarrow}k)\times Pr(\text{“Data”}\neg|\text{“Model”}\ X_{\downarrow}k))/(\Sigma_{\downarrow}i\ \text{[illegible]}\ Pr(\text{“Model”}\ X_{\downarrow}i$$

The terms in this equation are described below:

“Pr”(“Mode”$i$ $X_{\downarrow}$k|“Data”) is the posterior probability of Model $X_k$ given the data.

Pr(Model $X_k$) is the prior probability of Model $X_k$.

Pr(“Data”¬|“Model ” $X_{\downarrow}$k) is the likelihood of Model $X_k$ or the sampling distribution of the data given Model $X_k$.

Pr(Data, Model $X_k$) is the joint probability of Model $X_k$ and the data.

$$\sum_i Pr(\text{Data, Model, } X_i)$$

is the evidence for the system X of models.

In the context of peak assessment, having decided on the system of models, it is desired to seek the more probable models of the peak position and shape from which a judgement about the data can be made.

The general method employed for exploration of the parameter space may be a Markov Chain Monte Carlo (MCMC) method. The aim is to construct an ergodic Markov chain whose stationary distribution is proportional to the joint probability distribution of data and model parameters, i.e. the stationary distribution of the Markov chain is the desired posterior distribution of the model parameters [Neal, R. M. (1993) “Probabilistic inference using Markov chain Monte Carlo methods”, Technical Report CRG-TR-93-1, Dept. of Computer Science, University of Toronto]. The chain is constructed using transitions which leave this desired distribution invariant. This can be ensured by requiring transitions to obey detailed balance with respect to the desired distribution. This is the guarantee that the probability of being in state x (according to the desired distribution) and making the transition to state y is equal to the probability of being in state y and making the transition to state x for any pair of states x and y. In order to approach the desired distribution from an arbitrary starting point, the Markov chain must be ergodic, i.e. it must have only the desired distribution as its invariant. This is achieved if every state of non-zero probability in the desired distribution is accessible from every other state by a transition. John Skilling’s variant of slice sampling is used to explore each variable in turn [Neal, R. M. (2003) “Slice Sampling”, Annals of Statistics, 31 (3), 705-767]. In this scheme, the Markov chain will be ergodic if the conditional probability distribution for each variable explored is strictly positive.

The first requirement in investigating peak shape is to locate the peak of interest. As described above in relation to FIG. 2, it is helpful to strengthen the search for the peak of interest by including isotopes in the pattern of intensities sought. It is also helpful, at this stage, not to allow the peak width or shape to vary as the peaks are often reasonably sharp on top of a broad background hump. Varying the peak width would allow the background hump to be located rather than the peak. The peak may be located to within a coarse tolerance, for example 2 Da, of the theoretical value for the compound of interest. The tolerance may then be reduced when the peak width and shape variables are brought into play. The prior probability distribution for peak position is preferably symmetrically biased towards the expected position within the given tolerance.

As described above in relation to FIG. 4, the model accounts for precursor defects and shoulder defects by endowing the first set of spectral data (a principal isotope cluster of the compound of interest) with a related second set of spectral data (a precursor isotope cluster) appearing at lower mass than the principal cluster. The two clusters have associated quantities (areas under curves), $q_0$, $q_1 \geq 0$, for the principal and precursor clusters, respectively. Only the principal peak of the first set of spectral data has a shape parameter, h>0, with the precursor peak of the second set of spectral data having a shape being restricted to the pseudo-Gaussian form. This model is rigid enough so that, for example, there is no difficulty in arriving at an average precursor curve as the precursor and principal curves can be identified in any Monte Carlo sample. If more possible contributions were to be taken into consideration by, for example, attempting to model a precursor defect and a shoulder defect simultaneously, the problem of interpreting the information in the Monte Carlo samples in terms of defects would become more difficult.

A good strategy for random exploration is to slave model variables through a simple transformation or chain of such transformations to a number, $r\epsilon(0,1)$ that can then be chosen with uniform probability. This construction gives useful but perhaps unconventional forms for the prior distributions of the variables. It is sometimes useful to transform to an intermediate variable, $u\epsilon(0,1)$, which may not have uniform probability distribution, for instance through an adjustment of the median, $\mu\epsilon(0,1)$, by $$\frac{\mu}{1-\mu}\frac{r}{1-r}=\frac{u}{1-u},$$

or bias towards centre by $$\frac{r}{1-r}-\left(\frac{u}{1-u}\right)^p,\ p>1,$$

or Pr(u=0)=0, maintaining median $\mu$ by $$\frac{\mu^p}{1-\mu^p}\frac{r}{1-r}=\frac{u^p}{1-u^p},\ p>1.$$

The probability distribution for a variable x where $x=r(\mu(x))$ is given by the derivative, $$\frac{dr}{dx},$$

perhaps most easily arrived at through the chain rule for differentiation. Table 1 below gives the transformations used to model the data as a pair of isotope clusters.

TABLE 1

| Variable | Description | Transformation | Comments |
|---|---|---|---|
| $x_0$ | Location of principal isotope cluster as offset from start of region of interest | $\frac{r}{1-r} = \left(\frac{u}{1-u}\right)^2, u = \frac{1}{2}\left(\frac{x_0 - c}{2\Delta}\right)$ | $x_0 \in (c - \Delta, c + \Delta)$, $Pr(x_0)$ biased towards $x_0 = c$. |
| $x_1$ | Location of precursor isotope cluster | $\frac{\mu'}{1-\mu^2}\frac{r}{1-r} = \frac{u'}{1-u^2}, u = 1 - \frac{x_1}{x_0}$ | $\mu > 0$, $x_1 \in (0, x_0)$, $Pr(x_1)$ vanishes as $x_1$ approaches $x_0$. Normalisation depends on current value of $x_0$ |
| $w_0$, $w_1$ | Peak FWHM | $\frac{r}{1-r} = \left(\frac{u}{1-u}\right)^2, u = e^{\frac{\ln 1}{2}\frac{w-c}{\mu-c}}$ | $\mu > c \geq 0$, $w \in (c, \infty)$ |
| h | Quadratic half-width at base of principal peaks | $r = e^{\frac{\ln 1}{2}\frac{k}{\mu}}$ | $\mu > 0$, $h \in (0, \infty)$ |
| g | Detector gain | $\mu\frac{r}{1-r} = g$ | $\mu > 0$, $g \in (0, \infty)$ |

Variable transformations defining prior probability distributions for model exploration. Intentisites (or quantities) for the principal and precursor clusters are not listed as they are dealt with through marginalisation.

Figure 8:
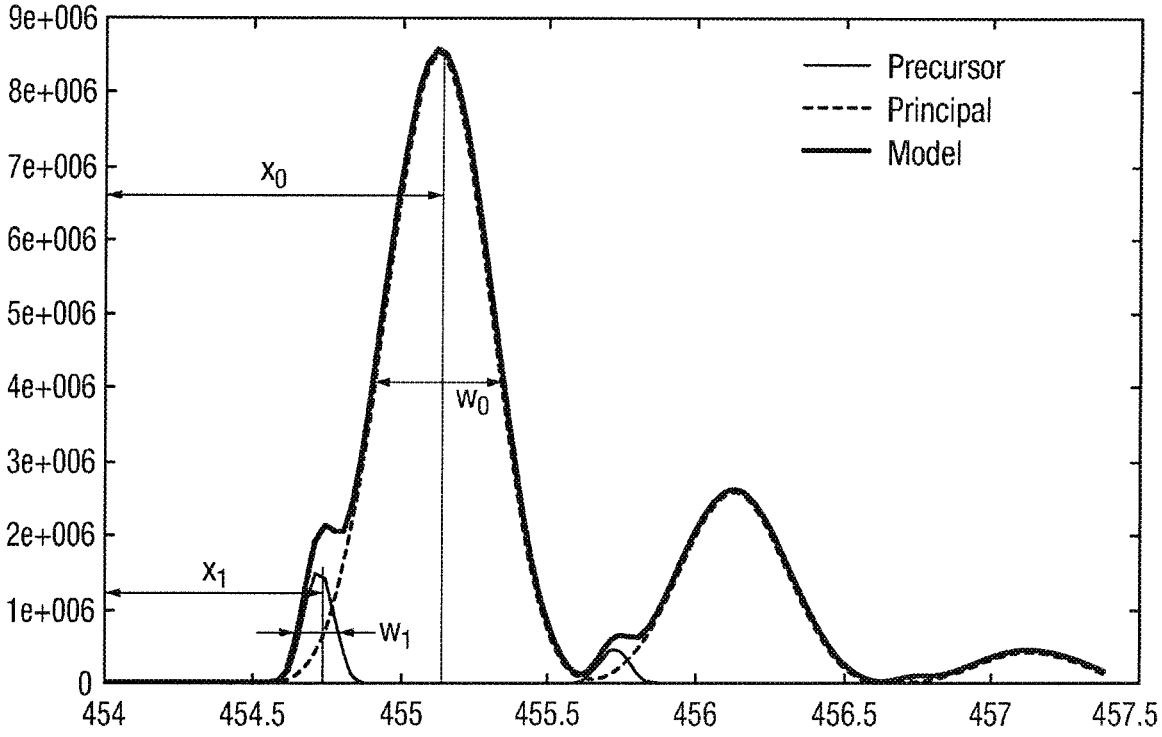
FIG. 8 shows various measurements in a modelling method according to a preferred embodiment of the present invention.

FIG. 8 shows a principal isotope cluster (i.e. a first set of spectral data) and a precursor isotope cluster (i.e. a second set of spectral data). The overall model data set for the peak shapes is shown and is the sum of the precursor isotope spectrum and the principal isotope spectrum. The distances $x_0$, $x_1$, $w_0$ and $w_1$ are as described in Table 1 above. The quantities not shown here are h, the amount of the quadratic component in the principal peak and g, the gain value. Intensity is on an arbitrary scale, so the gain value is used to relate observed intensity to ion counts in an approximate manner. The quantities $q_0$ and $q_1$ correspond to the areas under the principal isotope spectrum and the precursor isotope spectrum respectively.

Part of the peak assessment may be done simply by inspecting the (smoothed) data once the relevant peaks have been located. The height of the valley between the first two isotopes of an isotope cluster is easily assessed in this way, as is the peak width. More subtle defects are better assessed by examining the output of the modelling process. The precursor isotope cluster (i.e. second set of spectral data) may give rise to defects categorised as "precursor defects" (see FIG. 9) or "shoulder defects" (see FIG. 10) depending on its size, shape and displacement from the principal cluster (i.e. first set of spectral data). In order to focus on the region of data where such defects are manifested, the Poisson error-bars on the data may be modulated so that the limited flexibility in the model is not used up accounting for regions of data that are of lesser importance.

Figure 9:
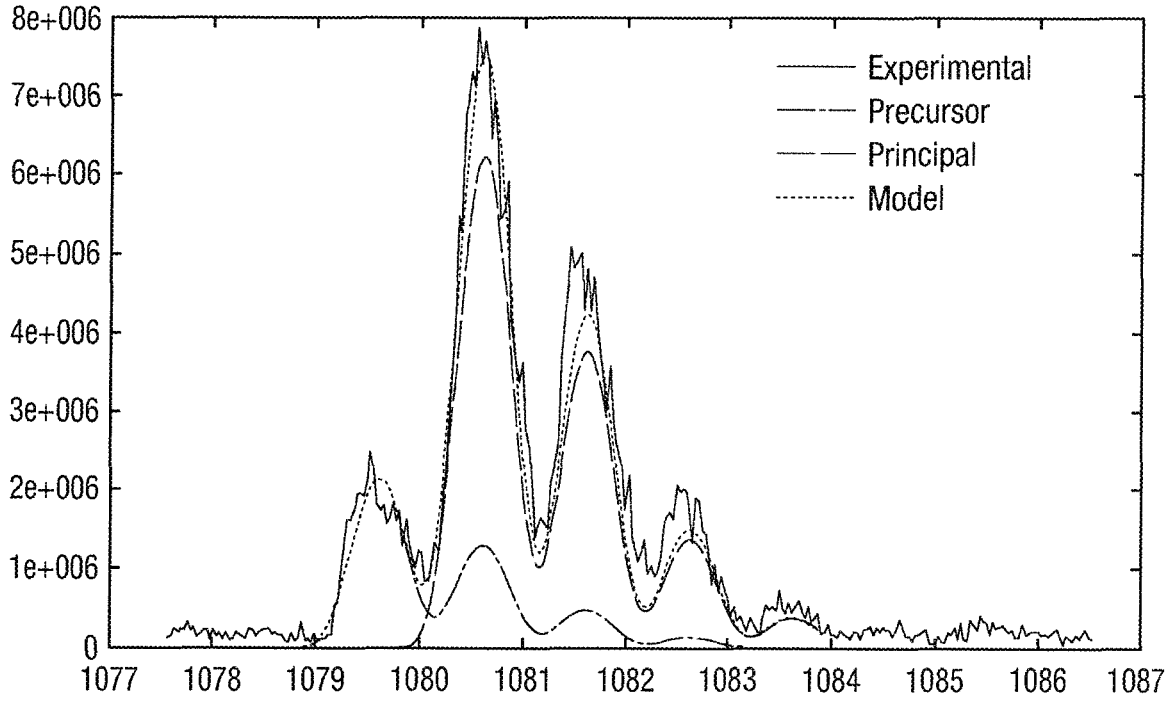
FIG. 9 shows a preferred embodiment of the present invention used for modelling a precursor peak defect.

FIG. 9 shows the result of modelling a $C_{54}H_{112}O_{20}$ isotope cluster for an instrument showing a significant precursor defect. The experimental data is shown as the jagged plot. The cluster is modelled as a principal component (i.e. first set of spectral data) preceded by a precursor component (i.e. second set of spectral data). The sum of the precursor and principal spectra provides the overall model data set. A precursor defect is identified by the existence of a minimum in the overall data set spectrum between a peak of the precursor spectrum and the corresponding peak of the principal spectrum.

Figure 10:
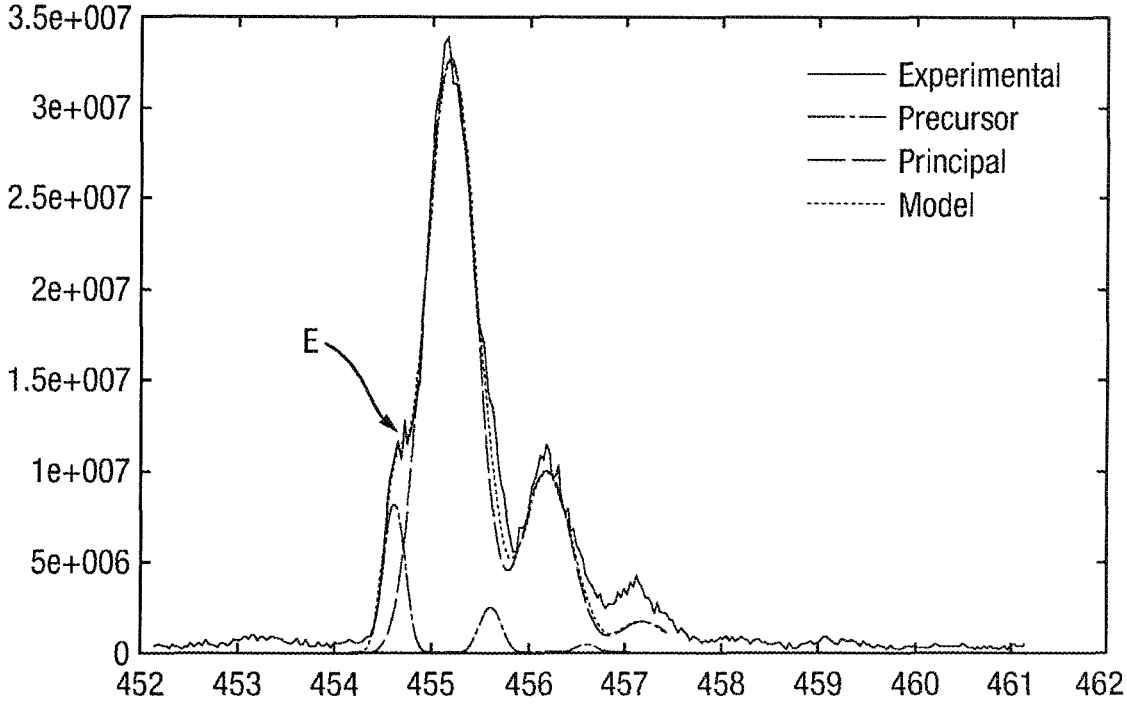
FIG. 10 shows a preferred embodiment of the present invention used for modelling a shoulder defect.

FIG. 10 shows the result of modelling an isotope cluster showing a shoulder defect. The experimental data is shown as the jagged plot. The cluster is modelled as a principal component (i.e. first set of spectral data) preceded by a precursor component (i.e. second set of spectral data). The sum of the precursor and principal spectra gives the overall model data set. A shoulder defect is identified with the absence of a precursor defect and the existence of a point at which the precursor spectrum exceeds the principal spectrum. If such a point exists, its height is taken to be the height of the overall model data set spectrum at the closest such point to the centre of the principal peak. The vertical dashed line in FIG. 10 indicates the position where the precursor curve exceeds the principal curve closest to its peak. The shoulder height is indicated at point E.

The variance ratio of the peak is defined to be the ratio of the variance to the precursor plus principal model for the mono-isotopic peak to the variance of an ideal peak of the measured full width at half maximum height. If this ratio is much greater than one, it may indicate that a shoulder defect has reached an unacceptable level. The main peak in FIG. 10 shows a shoulder defect with variance ratio 1.2%.

The leading edge extent of a peak is taken to be the mass difference between the point where the overall model data set spectrum first exceeds 1% of the peak height and the position of the peak unless a precursor defect is identified, in which case it is the corresponding mass difference considering only the principal spectrum.

Once a defect has been identified, it may be subjected to further examination of its magnitude and disposition so that a final assessment of peak quality may be reached.

Although the present invention has been described with reference to preferred embodiments, it will be understood by those skilled in the art that various changes in form and detail may be made without departing from the scope of the invention as set forth in the accompanying claims.

For example, although the preferred embodiments has been described in relation to detecting defects in peaks, the present invention can also be used for peak deconvolution, e.g. in routine mass measurements.

The invention claimed is:

1. A method of tuning a mass spectrometer comprising:

providing experimentally obtained mass spectral data from a mass spectrometer;

selecting a chemical compound, and modelling the spectral data that would be detected for the compound, wherein said step of modelling comprises:

generating a first set of spectral data including multiple mass peaks that are predicted to be detected for the selected compound;

generating a second set of spectral data by duplicating at least part of the first set of spectral data and shifting multiple mass peaks in mass to charge ratio relative to the corresponding multiple mass peaks in the first set of spectral data; and summing the amplitudes of the first and second sets of spectral data to produce a model data set having multiple mass peaks;

said method further comprising:

comparing the model data set to the experimentally obtained data;

determining that the model data set matches the experimentally obtained mass spectral data;

determining that there is a defect in the experimentally obtained data as a result of determining that the model data set matches the experimentally obtained mass spectral data; and tuning the mass spectrometer so as to eliminate the defect when the mass spectrometer subsequently analyses said compound.

2. The method of claim 1, wherein the step of providing the experimentally obtained mass spectral data comprises mass analysing at least one compound in a mass spectrometer.

3. The method of claim 1, wherein the step of modelling the spectral data predicted to be detected if the compound was to be mass analysed comprises modelling the plural mass peaks that would be detected if the compound contained multiple different isotopes of one or more of the chemical elements in the compound, such that the first set of spectral data includes a plurality of mass peaks; and wherein the second set of spectral data includes said plurality of mass peaks, wherein each of the plurality of mass peaks in the second set of spectral data is shifted in mass to charge ratio relative to the corresponding mass peak in the first set of spectral data.

4. The method of claim 1, wherein the mass peaks in the second set of mass spectral data are shifted to lower mass to charge ratios relative to their corresponding mass peaks in the first set of mass spectral data.

5. The method of claim 1, wherein said step of generating the first set of spectral data comprises predicting the mass to charge ratio of said multiple mass peaks that are predicted to be detected for the selected compound, and applying a peak shape to each of the multiple mass peaks.

6. The method of claim 5, wherein the peak shape is a Gaussian function or a quadratic function, or wherein a first mathematical function is convolved with a second mathematical function in order to generate the peak shape.

7. The method of claim 6, wherein the peak shape of each of the plurality of peaks is a convolved function of a Gaussian and a quadratic, wherein the peak shape of a peak at low mass to charge ratio is determined from the convolved function of a Gaussian having a small width and a quadratic having a larger width, and wherein the peak shape of a peak at high mass to charge ratio is determined from the convolved function of a Gaussian having a large width and either a quadratic having a smaller width or a delta function.

8. The method of claim 1, wherein each peak in the second set of spectral data has a different amplitude to its corresponding peak in the first set of spectral data; or wherein at least one of the peaks in the second set of spectral data has a different amplitude to its corresponding peak in the first set of spectral data; and/or wherein each peak in the second set of spectral data has a different shape to its corresponding peak in the first set of spectral data; or wherein at least one of the peaks in the second set of spectral data has a different shape to its corresponding peak in the first set of spectral data.

9. The method of claim 1, wherein the method comprises generating a plurality of sets of first spectral data, wherein at least some of the corresponding peaks in the different sets of first spectral data have different amplitudes and/or different peak shapes, the method further comprising generating said second set of spectral data for each one of said sets of first spectral data, the method further comprises summing the amplitudes of the mass peak(s) in each set of first mass spectral data with the amplitudes of the mass peak(s) in its corresponding second set of spectral data so as to provide a plurality of summed model data sets, comparing each set of summed model data to the experimentally obtained data; and determining the model data set that best matches the experimentally obtained mass spectral data; and identifying a feature or peak of the experimentally obtained data from the first and/or second sets of data in the best matching model data set.

10. The method of claim 1, wherein said step of identifying a feature or peak of the experimentally obtained data comprises: determining that the amplitude of the summed model data set has a minimum or trough located between a first mass peak in the first set of spectral data and a corresponding first mass peak in the second set of spectral data, wherein a portion of the experimentally obtained data having a mass range equivalent to the mass range of the first or second mass peak on either side of the minimum is considered or indicated as being a defect in the experimentally obtained data.

11. The method of claim 1, wherein said step of identifying a feature or peak of the experimentally obtained data comprises: determining that a first peak of the first data set only partially overlaps with a corresponding first peak of the second data set, and determining that the amplitude of the summed model data set does not have a minimum or trough located between the two first peaks, wherein the mass range of the non-overlapping portion of the first peak of the first data set or the mass range of the non-overlapping portion of the first peak of the second data set is considered or indicated as being the mass range of the experimentally obtained data that contains a defect.

12. The method of claim 10, wherein the lowest mass range of the two first mass peaks is considered to be equivalent to the mass range of the defect in the experimentally obtained data.

13. The method of claim 1, wherein predetermined different types of defect and/or predetermined different sources of defect are associated with different data model sets, wherein the method determines the most likely data model set to match the experimentally obtained data and then signals the associated type and/or source of defect to the operator.

14. A mass spectrometer comprising:

a controller arranged and configured to:

provide experimentally obtained mass spectral data;

select a chemical compound, and modelling the spectral data that would be detected for the compound, wherein said step of modelling comprises:

generate a first set of spectral data including multiple mass peaks that are predicted to be detected for the selected compound;

generate a second set of spectral data by duplicating at least part of the first set of spectral data and shifting multiple mass peaks in mass to charge ratio relative to the corresponding multiple mass peaks in the first set of spectral data; and sum the amplitudes of the first and second sets of spectral data to produce a model data set having multiple mass peaks;

compare the model data set to the experimentally obtained data;

determine that the model data set matches the experimentally obtained mass spectral data;

determine that there is a defect in the experimentally obtained data as a result of determining that the model data set matches the experimentally obtained mass spectral data; and tune the mass spectrometer so as to eliminate the defect when the mass spectrometer subsequently analyses said compound.

* * * * *